US005803050A

United States Patent [19]

Osakabe et al.

[11] Patent Number: 5,803,050

[45] Date of Patent: Sep. 8, 1998

[54] FUEL INJECTED INDUCTION SYSTEM FOR MARINE ENGINE

[75] Inventors: Takayuki Osakabe; Hitoshi Watanabe, both of Hamamatsu, Japan

[73] Assignee: Sanshin Kogyo Kabushiki Kaisha, Japan

[21] Appl. No.: 603,748

[22] Filed: Feb. 20, 1996

[30] Foreign Application Priority Data

Feb. 17, 1995 [JP] Japan ..... 7-029186

[51] Int. Cl.[6] ..... F02M 37/04

[52] U.S. Cl. ..... 123/456; 123/73 A; 123/541

[58] Field of Search ..... 123/456, 541, 123/73 A, 468, 469, 470

[56] References Cited

U.S. PATENT DOCUMENTS

| | | | |
|---|---|---|---|
| 4,702,202 | 10/1987 | Hensel et al. . | |
| 4,784,090 | 11/1988 | Sougawa | 123/73 A |
| 4,848,283 | 7/1989 | Garms | 123/541 |
| 4,920,933 | 5/1990 | Iwai | 123/73 A |
| 5,024,188 | 6/1991 | Hartke | 123/73 A |
| 5,085,180 | 2/1992 | Torigai | 123/73 A |
| 5,259,356 | 11/1993 | Karlson | 123/541 |
| 5,309,885 | 5/1994 | Rawlings | 123/541 |
| 5,349,928 | 9/1994 | Takahashi | 123/73 A |
| 5,450,830 | 9/1995 | Katoh | 123/73 A |
| 5,522,362 | 6/1996 | Motose | 123/73 A |
| 5,577,477 | 11/1996 | Katoh | 123/456 |

*Primary Examiner*—Carl S. Miller

*Attorney, Agent, or Firm*—Knobbe, Martens, Olson & Bear, LLP

[57] ABSTRACT

A fuel injected induction system for a crankcase compression, two-cycle, V-type internal combustion engine includes a plurality of throttle valves corresponding in number to the number of crankcase chamber of the engine. Each throttle valve communicates with a dedicated intake passage that directly communicates with a respective crankcase chamber. At least one fuel injector is positioned within each intake passage in order to form the air/fuel charge delivered to the crankcase chamber. The corresponding number of throttle valves, fuel injectors and crankcase chambers allows for enhanced control over the air-fuel ratio delivered to each of the cylinders, as well as improved consistence of the air-fuel charge delivered to each of the cylinders of the engine.

29 Claims, 8 Drawing Sheets

FUEL INJECTED INDUCTION SYSTEM FOR MARINE ENGINE

BACKGROUND OF THE INVENTION

1. Field of the Invention

The present invention relates in general to an internal combustion engine. In particular, the present invention relates to a fuel injected induction system for a marine engine.

2. Description of Related Art

A conventional two-cycle, crankcase compression, V-type internal combustion marine engine includes an induction system with fewer number of throttle valve than cylinders. That is, the induction system of prior two-cycle, V-6 engines commonly provides one to four throttle valves for the six cylinders. The throttle bodies of these valves open into a common intake chamber in an intake manifold. Each cylinder and corresponding crankcase chamber draws in air from the common chamber. U.S. Pat. No. 4,702,202 discloses an example of a conventional two-stroke V-6 marine engine with this conventional induction system.

Prior intake manifolds used with conventional two-cycle V-6 marine engines tend to distribute air-fuel mixture unevenly between cylinders because of the non-uniform flow passages through the intake manifold to each cylinder. That is, because of variations in flow restrictions and lengths of induction paths between the cylinders, the induction system tends to deliver inconsistent air/fuel mixtures between the cylinders. One cylinder may tend to run richer than another cylinder. As a result, engine combustion becomes inconsistent and the resultant inefficiencies effect the engine performance.

The prior arrangement of-the fuel injection circuit and the throttle linkage in these engines have also resulted in a large, overly complicated design. The fuel injectors and fuel rod commonly lie on the same side of the intake manifold as the throttle linkage lies. The arrangement of the fuel injectors, fuel rod, throttle valves and throttle linkage all on the same side of the intake manifold has produced a complicated mounting layout which takes significant time to assembly and increases the size of the engine.

SUMMARY OF THE INVENTION

A need therefore exists for a simply structured fuel injected induction system for a two-cycle, crankcase compression, internal combustion engine which enhances control over the air-fuel ratio delivered to each of the cylinders and improves the consistence of the air-fuel charges delivered to each of the cylinders of the engine.

Accordingly, one aspect of the present invention involves an induction system for a two-cycle, crankcase compression, internal combustion engine. The engine has multiple cylinders which communicate with independent crankcase chambers. The induction system is attachable to a crankcase member of the engine on a side opposite of the cylinders and comprises an intake manifold which defines a plurality of intake passages. Each intake passage communicates with a respective one of the crankcase chambers. A plurality of throttle devices control air flow into the intake passages. Each throttle device communicates with a respective one of the intake passages.

In accordance with another aspect of the present invention, a fuel injected induction system for a two-cycle, crankcase compression, internal combustion engine is provided. The engine includes multiple cylinders with each cylinder communicating with a respective crankcase chamber of the engine. The fuel injected induction system is attached to the engine on the opposite side of the crankcase chambers from the cylinders and comprises a plurality of intake passages formed in an intake manifold. Each intake passage communicates with one of the crankcase chambers. A fuel rod extends across the air flow path through each of the intake passages and supplies fuel to a plurality of fuel injectors. One of the fuel injectors is disposed within each of the intake passages to form the fuel/air charge delivered to the respective crankcase chamber.

An additional aspect of the present invention involves a fuel injected induction system for a two-cycle, crankcase compression, V-type internal combustion engine. The engine has multiple cylinders with each cylinder communicating with a dedicated crankcase chamber. The induction system is attached to the engine on the opposite side of the crankcase chambers from the cylinders. The induction system includes at least one air flow passage communicating with a plurality of intake passages. Each intake passage communicates with one of the crankcase chambers. A fuel rod supplies fuel to a plurality of fuel injectors. At least one of the fuel injectors is disposed within each of the intake passages and is positioned to align its spray axis with a central plane of the V-type engine. The fuel rod is mounted within the air flow passage.

In accordance with further aspect of the present invention, a fuel injected induction system for a two-cycle, crankcase compression, internal combustion engine is provided. The engine has multiple cylinders each of which communicates with a respective one of a plurality of crankcase chambers. The induction system comprises plurality of intake passages. Each of the intake passages communicates with a respective one of the crankcase chambers. A plurality of fuel injectors are positioned such that one of the fuel injectors lies within each of the intake passages. A fuel rod is coupled to each fuel injector. The induction system also includes a plurality of throttle devices which correspond in number to the number of intake passages. The throttle devices are arranged such that one of the throttle devices communicates with a respective one of the intake passages. A throttle linkage is coupled to the throttle devices on an opposite side of the throttle devices from which the fuel rod lies. This arrangement presents a simply-structured induction system which allows for enhanced control of the air/flow charge delivered to each crankcase chamber.

BRIEF DESCRIPTION OF THE DRAWINGS

These and other features of the invention will now be described with reference to the drawings of several preferred embodiments of the invention which cumulatively are intended to illustrate the nature of the invention and are not intended to limit the invention in any way. The figures are as follows.

DETAILED DESCRIPTION OF PREFERRED EMBODIMENTS

Figure 1:
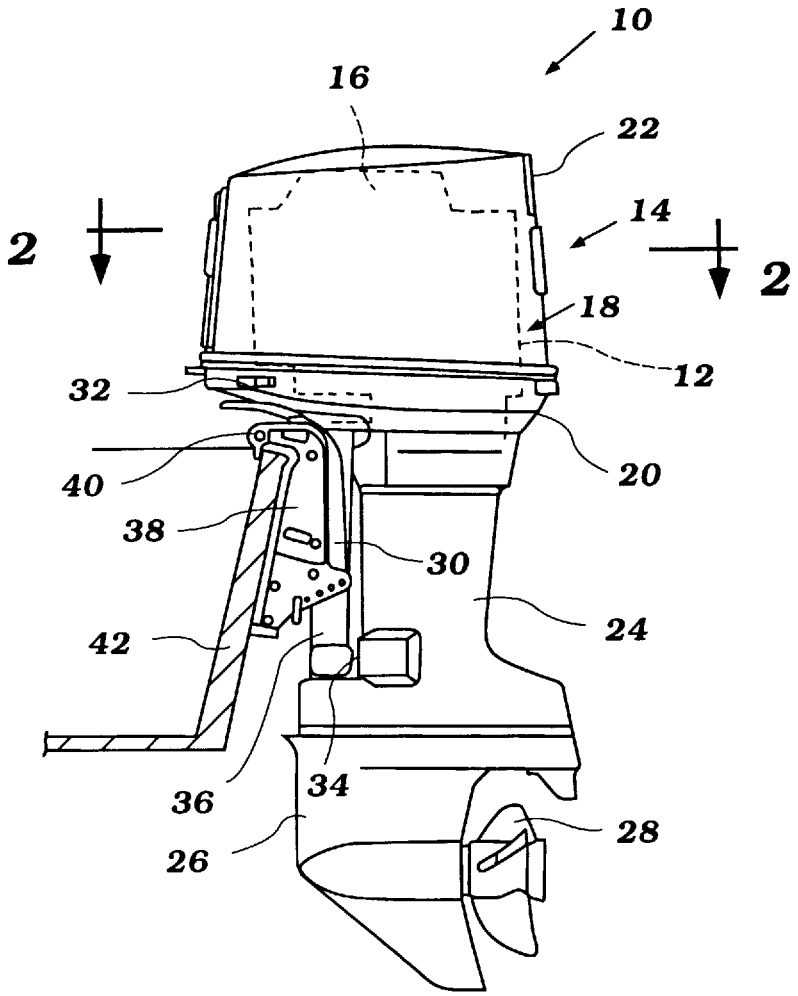
FIG. 1 is a side elevational view of a marine outboard motor incorporating a fuel injected induction system in accordance with a preferred embodiment of the present invention, the outboard motor being attached to the transom of an associated watercraft.

FIG. 1 illustrates a conventional marine outboard drive 10 of the type in which the present fuel injected induction system 12 can be incorporated. The present fuel injected induction system 12 has particular utility with marine drives employing two-cycle, crankcase compression, V-type internal combustion engines as the power unit. Because outboard motors commonly employ such engines, the inventive fuel injected induction system 12 is being described in connection with an outboard motor 10; however, the depiction of the invention in conjunction with an outboard motor is merely exemplary. Those skilled in the art will readily appreciate that the present fuel injected induction system 12 can be applied to an inboard motor of an inboard/outboard drive, to an inboard motor of a personal watercraft, and to other types of watercraft engines as well.

In the illustrated embodiment, the outboard drive 10 includes a power head 14 which includes an engine 16. A conventional cowling 18 surrounds the engine 16. The cowling 18 desirably includes a lower tray 20 and an upper cowling member 22. These components 20, 22 of the protection cowling 18 together define an engine compartment which houses the engine 16.

A drive shaft housing 24 extends downwardly from the lower tray 20 and terminates in a lower unit 26. The lower unit can house a transmission (not shown) which selectively establishes a driving condition of a propulsion device 28, such as, for example, a propeller. The transmission desirably is a forward-neutral-reverse type transmission. In this manner, the propulsion device 28 can drive the watercraft in any of these operating states.

A steering shaft 30 is affixed to the drive shaft housing 26 at upper and lower brackets 32, 34. The brackets 32, 34 support the shaft 30 for steering movement within a swivel bracket 36. Steering movement occurs about a generally vertical steering axis which extends through the steering shaft 30. A steering arm (not shown) which is connected to an upper end of the steering shaft 30 can extend in a forward direction for manual steering of the outboard drive 10, as known in the art.

The swivel bracket 36 also is pivotably connected to a clamping bracket 38 by a pin 40. The clamping bracket 40, in turn, is configured to attached to the transom 42 of the watercraft. This conventional coupling permits the outboard drive 10 to be pivoted relative to the pin 40 to permit adjustment of the trim position of the outboard drive 10 and for tilt-up of the outboard drive 10.

Although not illustrated, it is understood that a conventional hydraulic tilt and trim cylinder assembly, as well as a conventional hydraulic steering cylinder assembly can be used as well with the present outboard drive 10. The construction of the steering and trim mechanism is considered to be conventional and, for that reason, further description is not believed necessary for appreciation and understanding of the present invention.

The engine 16 is mounted conventionally with its output shaft 43 (i.e., crankshaft) rotating about a generally vertical axis 45. The crankshaft (FIG. 2) drives a drive shaft (not shown) which depends from the power head 14 of the outboard drive 10 and extends through and is journaled within the drive shaft housing 24. The drive shaft depends into the lower unit 26 to drive a drive gear of the transmission (not shown).

Figure 2:
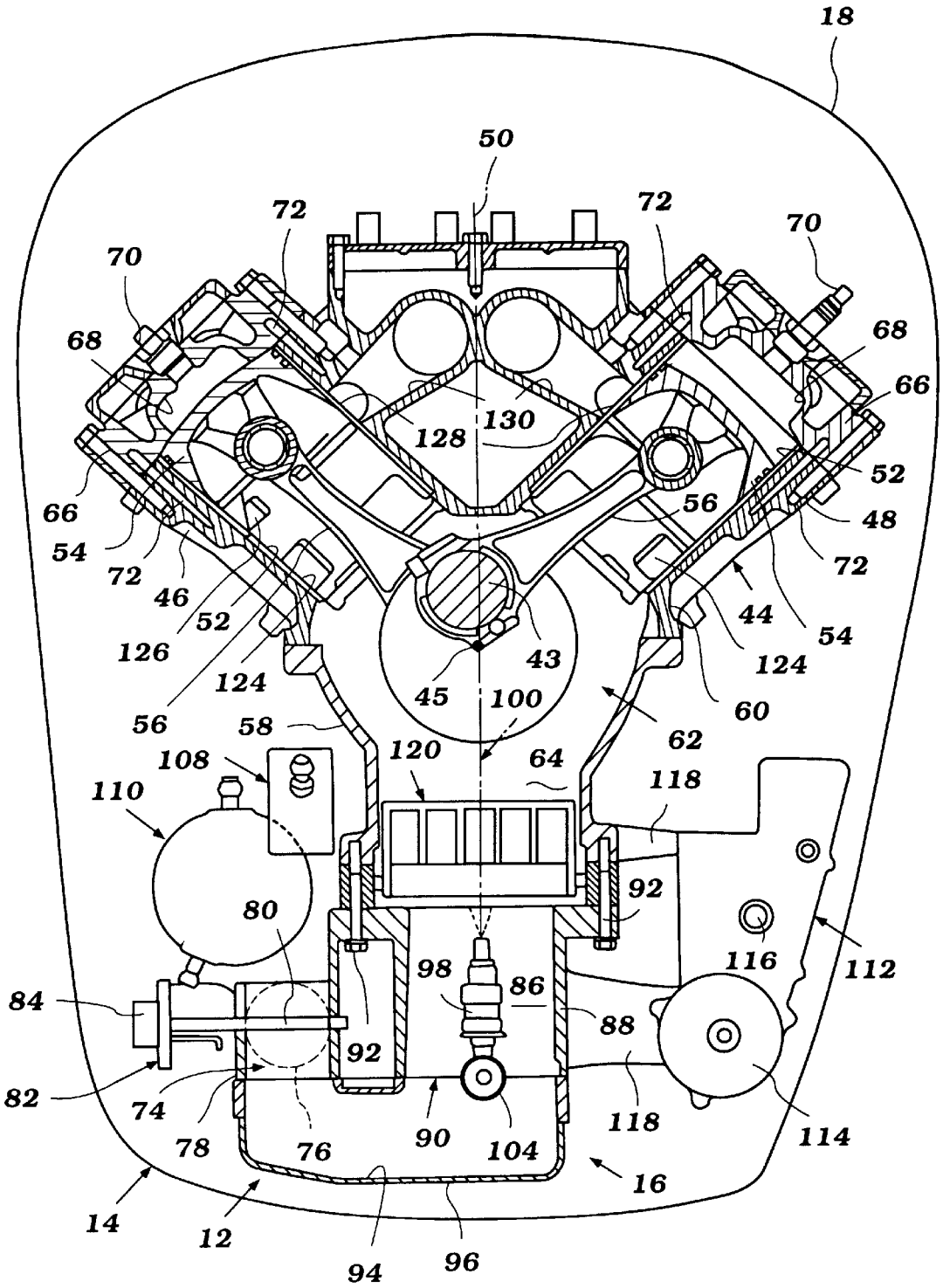
FIG. 2 is a cross-sectional view of an engine of the outboard motor of FIG. 1 taken along line 2—2 with portions a cylinder of a first bank of the engine being broken away to show the cylinder at a different elevational level than a corresponding cylinder and respective crankcase chamber of a second bank of the engine.

With reference to FIG. 2, the engine 16 desirably is a reciprocating multi-cylinder engine operating on a two-cycle crankcase compression principle. In the illustrated embodiment, the engine 16 has a V-type configuration, and specifically a V-6 cylinder arrangement. The present invention, however, may be applicable to engines having other cylinder arrangements, such as, for example, in-line or slant cylinder arrangements.

A cylinder block assembly 44 lies generally at the center of the engine 16. The cylinder block 44 includes a pair of inclined cylinder banks 46, 48. The cylinder banks 46, 48 extend at an angle relative to each other to give the engine 16 a conventional V-type configuration. As understood from FIG. 2, a vertical central plane 50 lies between the cylinder banks 46, 48 and bifurcates the engine 16. The vertical axis 45 about which the crankshaft rotates desirably lies within the central plane 50.

Each cylinder bank 46, 48 includes a plurality of parallel cylinder bores 52. A cylinder liner forms each cylinder bore 52. The cylinder liner is cast or pressed in place in the cylinder bank 46, 48. As is typical with V-type engine arrangements, the cylinder bores 52 of the first cylinder bank 46 are offset slightly in the vertical direction from the cylinders bores 52 of the second cylinder bank 48 so that the connecting rods of adjacent cylinders 52 can be journalled on the same throw of the crankshaft, as known in the art.

A piston 54 reciprocates within each cylinder bore 52. Connecting rods 56 link the pistons 54 to the crankshaft 43 so that reciprocal linear movement of the pistons 54 rotate the crankcase 43 in a known manner. The crankshaft 43 rotates about the vertical axis 45. The crankshaft 43 includes a plurality of spaced rod journals which lie off axis from the crankshaft 45. An end of one of the connecting rods 56 is coupled to the rod journal so as to link the corresponding piston 54 to the crankshaft 43 in a known manner.

A crankcase member 58 and a skirt 60 of the cylinder block assembly 44 cooperate to form the crankcase 62. The crankshaft 43 is journaled for rotation within the crankcase 62. The crankcase 62 is divided into a plurality of chambers 64, with each chamber 64 communicating with a respective cylinder bore 52. The adjacent crankcase chambers 64 are sealed from each other.

A cylinder head assembly 66 is affixed to each of the cylinder banks 46, 48. Each cylinder head assembly 66 includes a plurality of recesses 68. One of the recesses 68 cooperates with a respective cylinder bore 52. The respective recess 68, cylinder bore 52 and piston 54 define the variable volume chamber which, at minimum volume, defines the combustion chamber. Spark plugs 70 are mounted in the cylinder head assemblies 66 and are fired by a suitable ignition system (not shown).

As seen in FIG. 2, the cylinder block assembly 44 and the cylinder head assemblies 66 also define plurality of water jacket passages 72 which pass through the cylinder block assembly 44 and cylinder head assemblies 66 around the combustion chambers. These passages 72 form part of a conventional water cooling circulation system.

The induction system 12 delivers a fuel/air charge directly to the crankcase chambers 64 from the crankcase side of the engine 16. The induction system 12 thus communicates with each crankcase chamber 64 on a side of the engine 16 opposite of the cylinder banks 46, 48.

Figure 3:
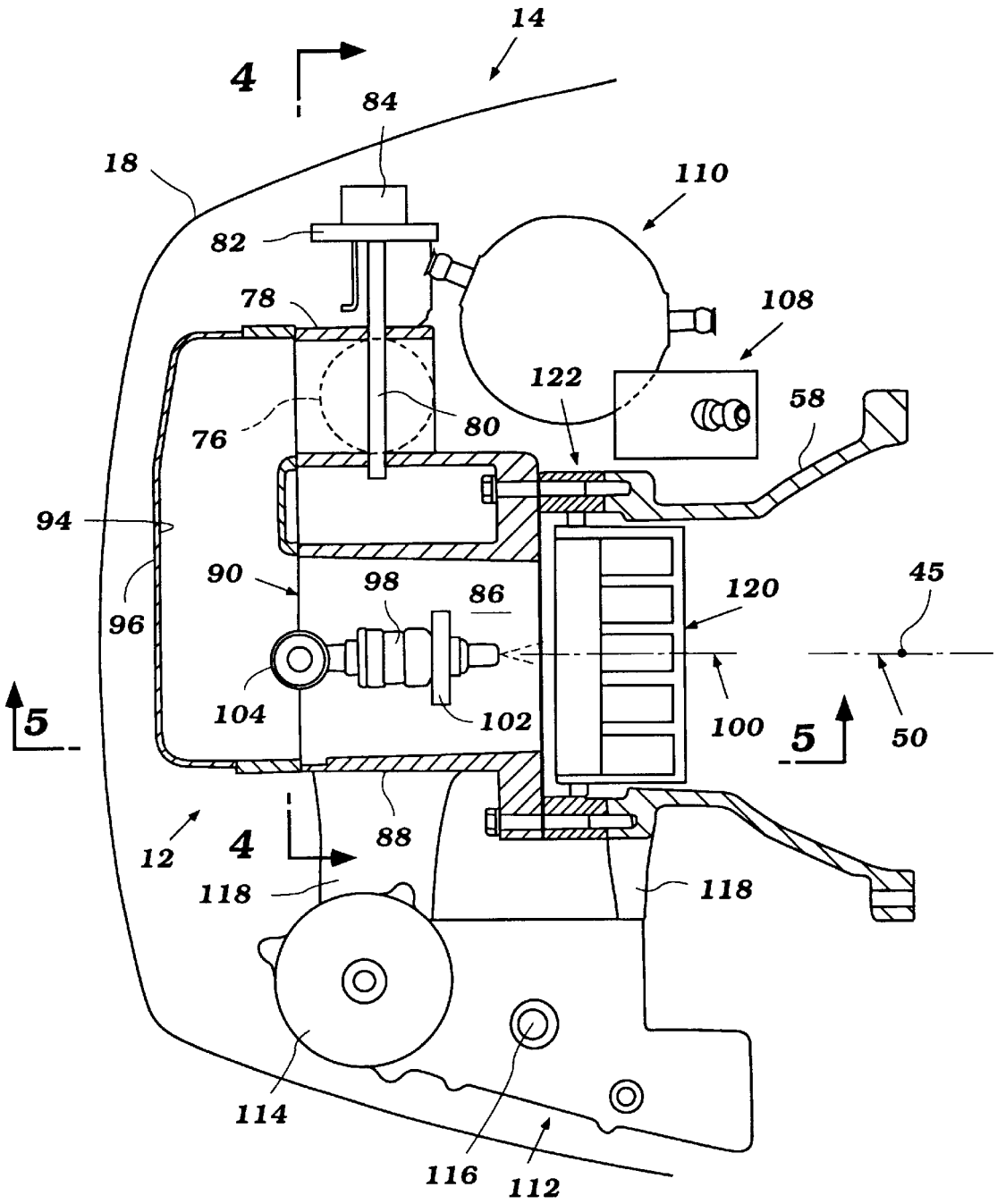
FIG. 3 is an enlarged side cross-sectional view of the fuel injected induction system of the engine of FIG. 2.
Figure 4:
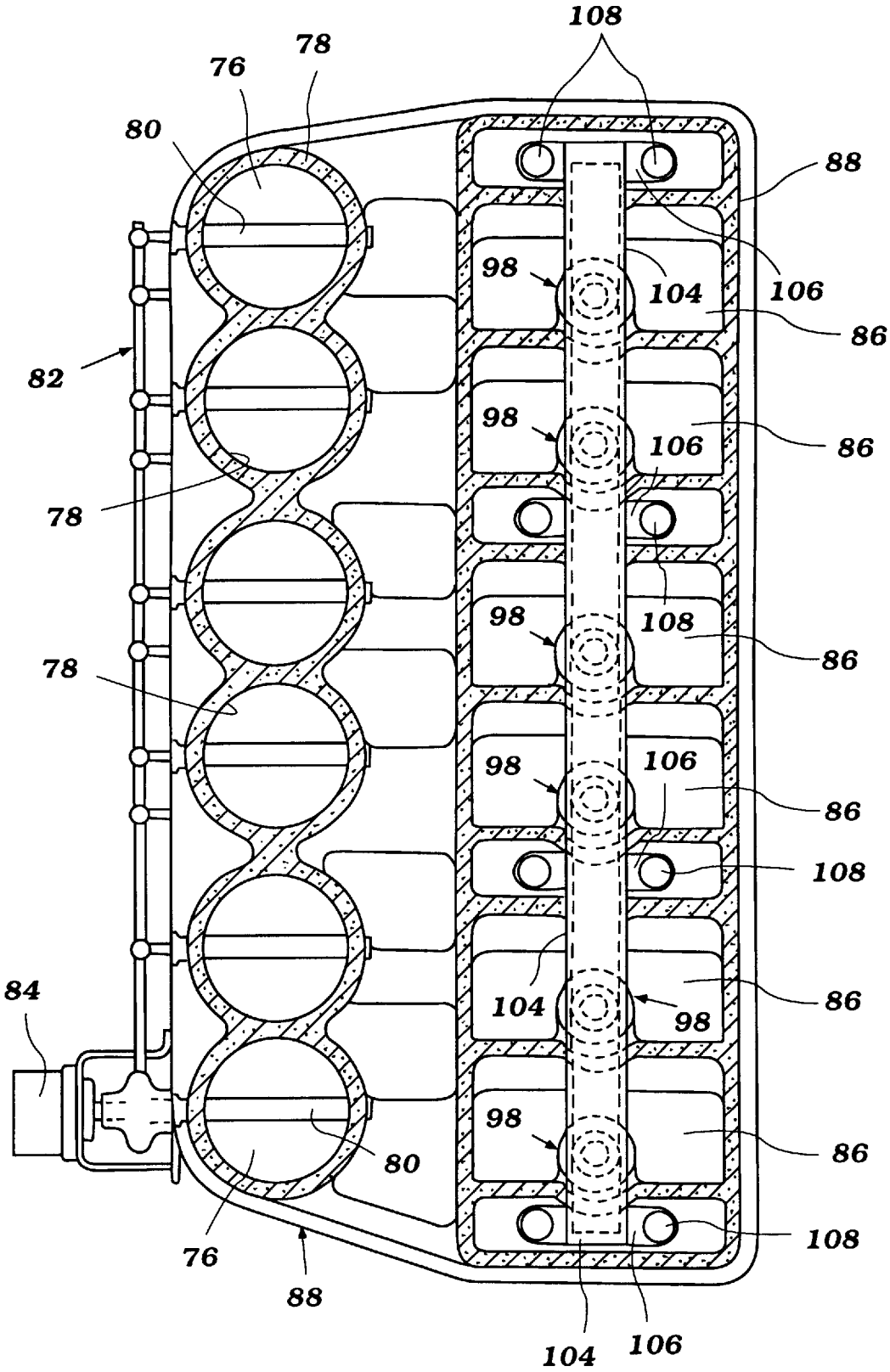
FIG. 4 is an enlarged cross-sectional rear side view of the fuel injected induction system taken along line 4—4 of FIG. 3.

As best seen in FIGS. 3 and 4, the induction system 12 includes a plurality of throttle devices to control the air flow into the engine 12. In the illustrated embodiment, each throttle device 74 includes an independent throttle valve 76 for each cylinder 52 and corresponding crankcase chamber 64 of the engine 12. That is, the induction system 12 includes a plurality of throttle valves 76 that correspond in number to the number of crankcase chambers 64. Each throttle valve 76 is dedicated to control the air flow into a respective crankcase chamber 64.

A separate throttle body 78 houses each throttle valve 76. A throttle shaft 80 supports the valve 76 within the throttle body 78. Inlet air passes through the throttle body 78 when the throttle shaft 80 is rotated to open the valve 76.

A throttle linkage 82 connects the throttle shafts 80 together so as to uniformly and simultaneously operate and control the throttle valves 76 in a known manner. The throttle linkage 82 lies on the outer side of the throttle bodies 78.

A throttle valve angle detector 84 can be used with the throttle linkage 82 in order to sense the opening degree to the throttle valves 76. The throttle valve angle detector 82 communicates with the electronic control unit (ECU) (not shown) to control the desired air/fuel ratio.

Each throttle device 72 communicates with a respective intake passage 86 formed in an intake manifold 88. In the illustrated embodiment, the flow axis through each throttle body 78 lies generally parallel to the flow axis through the corresponding intake passage 86. The intake passage 86 in turn communicates directly which the respective crankcase chamber 64. As seen in FIG. 2, the position of the intake passage 86 desirably aligns the center line (i.e., the flow axis) through the intake passage 86 with the central plane 50 of the engine 16.

In the illustrated embodiment, as best understood from FIGS. 3 and 4, the intake manifold 88 and throttle bodies 78 are integrally formed together. The throttle bodies 78 are aligned in a row on one side of the structure with the intake passages 86 aligned in a row on the opposite side and in parallel with the throttle bodies 78. The outlet ends of each throttle bodies 78 desirably lie within the same plane as the inlet end of the intake manifold 88. The outlet ends of the throttle bodies 78 and the inlet end of the intake manifold 88 together define a planar end mounting surface 90.

As seen in FIG. 3, bolts 92 attach the outlet end of the intake manifold to an end of the crankcase member 58 opposite the cylinder block assembly 44. In this position, the intake passages 86 are placed in communication with a respective crankcase chamber 64. The inlet end of the throttle bodies 78 also lie further away from the crankcase member 58 than the outlet end of the intake manifold 88. In this manner, air can be drawn into the induction system 12 with lessened restriction than with prior designs.

A dedicated runner 94 connects each throttle body 78 to the respective intake passage 86 of the intake manifold 88. As best understood from FIGS. 3 and 5, the runners 94 are integrally formed together within a manifold cover 96. The manifold cover 96 is attached to the planer end surface 90 of the intake manifold 88 and the throttle bodies 78 by conventional fasteners, such as, for example, bolts. In this manner, the cover 96 can be easily removed to provide easy access to the fuel injection system, which is disposed within the intake passages 86 in the intake manifold 88, as described below.

At least one fuel injector 98 injects fuel into the air stream passing through each intake passage 86. In the illustrated embodiment, the fuel injector 98 lies within the intake passage 86. As best understood in FIGS. 3 and 5, an individual fuel injector 98 is mounted in each intake passage 86 so that it is aligned substantially with the center line 50 of the engine 16. That is, with reference to FIG. 3, the spray axis 100 of each fuel injector 98 lies within the central plane 50 of the engine 16.

A boss 102 supports the fuel injector 98 in this desired position. The boss 102 extends transversely into the intake passage 86 from a side of the intake passage 86. The boss 102 includes an aperture which lies at about the central to the intake passage 86. The aperture receives a portion of the injector 98 to support the injector 98 in this central position. For this purpose, each fuel injector 98 can include an externally threaded section which is screwed into the aperture of the boss 102.

Each fuel injector 102 includes a solenoid winding which is energized in a conventional manner. When energized, the fuel injector 98 injects fuel into the air stream passing through the intake passage 86 in the intake manifold 88.

Figure 5:
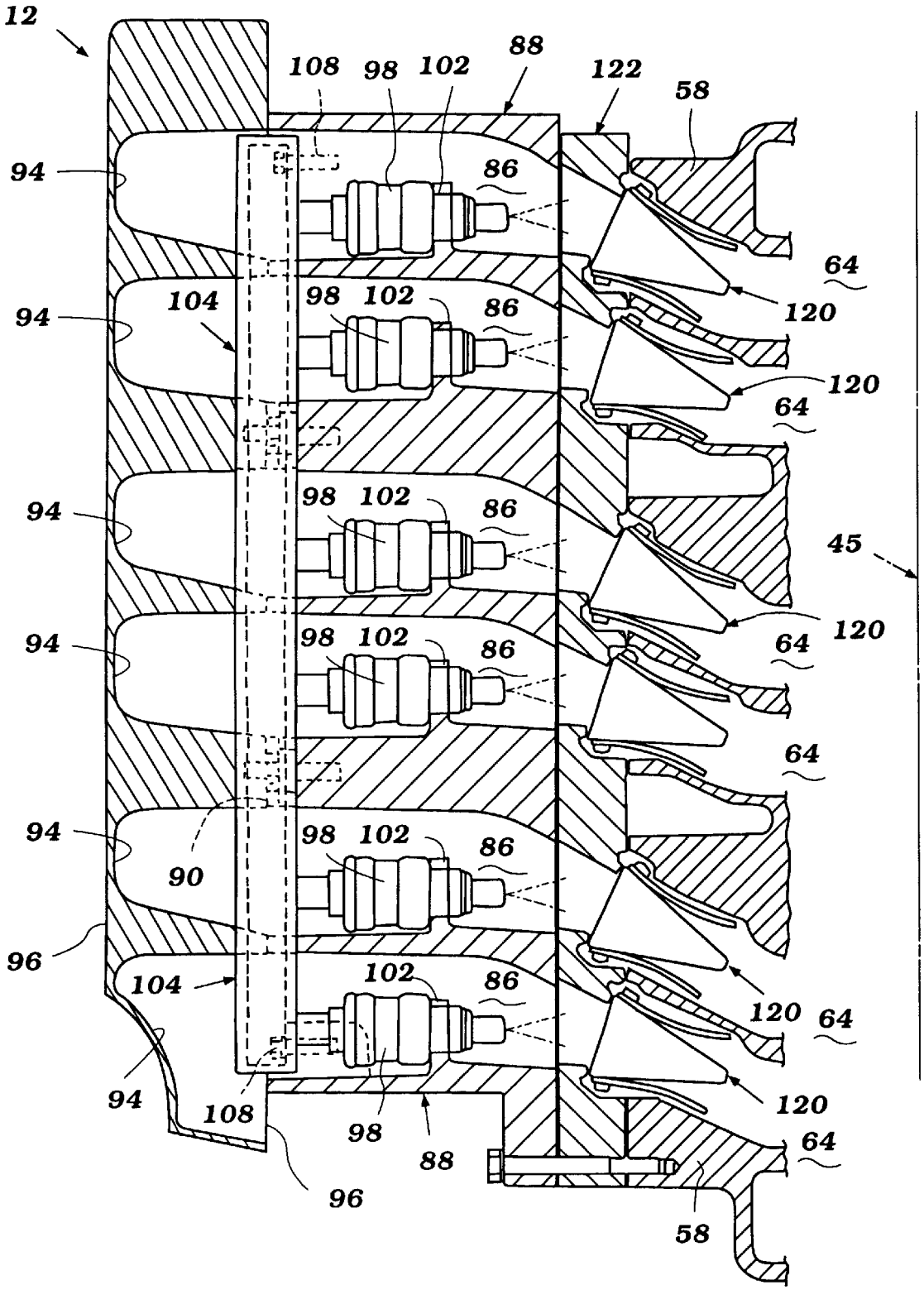
FIG. 5 is an enlarged side cross-sectional view of the fuel injected induction system taken along line 5—5 of FIG. 3.

A fuel rod 104 delivers fuel to each fuel injector 98. The fuel rod 104 desirably extends along the end surface 90 of the intake manifold 88 and is removably secured to the intake manifold 88. For this purpose, as best seen in FIGS. 4 and 5, the fuel rod 104 includes a plurality of flanges 106 which extend to the sides of the fuel rod 104. Bolts 108 attach the flanges 106 to the intake manifold 88 at the upper and lower ends of the manifold 88 as well as at several points between the intake passages 86. In this manner, the fuel rod 104 is securely mounted to the intake manifold 88 while being easily removed for servicing. The limited contact between the fuel rod 104 at its mounting flanges 106 and the intake manifold 88 also limits heat conduction to the fuel rod 104.

The fuel rod 104 desirably lies within the air flow stream flowing through the induction system 12 in order to cool the fuel within the fuel rod 104. Cooling the fuel inside the fuel rod helps maintain the fuel in a liquid state. For this purpose, the fuel rod 104 extends across the air flow path through each runner 94 and the corresponding intake passage 86 in the intake manifold 88. In the illustrated embodiment, the fuel rod 104 extends transversely across each of the intake passages 86 and lies generally parallel to the vertical axis 45 about which the crankshaft 43 rotates.

As best understood from FIG. 4, the fuel rod 104 and the throttle linkage 82 lie generally parallel to each other. Both the fuel rod 104 and the throttle linkage 82 also extend in directions which are parallel to the row of throttle bodies 78 and the row of intake passages 86. In order to simplify the construction of the induction system 12, the throttle linkage 82 desirably lies on a side of the throttle bodies 78 opposite of the fuel rod 104. That is, the throttle linkage 82 lies to the outside of the intake manifold assembly.

A fuel delivery system delivers highly pressurized fuel to the fuel rod 104. The fuel system includes a fuel tank (not shown) which is provided externally of the outboard drive 10, normally within the hull of the watercraft. With reference to FIG. 2, a low-pressure pump 108 draws fuel through a conduit (not shown) and through a fuel filter 110. The fuel filter 110 and low-pressure pump 108 are located within the cowling 18 adjacent to the throttle bodies 78 and the intake manifold 88. The low-pressure fuel pump 108 supplies fuel to a vapor separator 112 located on the opposite side of the intake manifold 88. The vapor separator 112 separates fuel vapor from the fuel and delivers the vapor to the induction system 12, in a known manner.

A conduit (not shown) delivers fuel from the separator 112 to a high-pressure fuel pump 114. The high-pressure fuel pump 114 delivers fuel to the fuel rod 104 which supplies fuel to the individual fuel injectors 98, as described above. A pressure regulator 116 desirably is disposed between the high-pressure fuel pump 114 and the fuel rod 104 so as to maintain a uniform fuel pressure at the injectors 98 (e.g., 50–100 atm). The regular 116 regulates pressure by dumping excess fuel back to the vapor separator 112, as known in the art. The above description of the construction of the fuel delivery system is generally conventional, and, thus, further details of the fuel delivery system are not necessary for an understanding of the present induction system 12.

As best seen in FIG. 2, the intake manifold 88 desirably supports several components of the fuel delivery system. For this purpose, the intake manifold 88 includes a plurality of support ribs 118 which extend to the side of the intake manifold 88, on the side opposite that at which the throttle bodies 78 are positioned. In the illustrated embodiment, the support ribs 118 support the fuel separator 112 and pressure regulator 116, as well as the high pressure pump 114. The fuel separator 112, pressure regulator 116 and high pressure pump 114 desirably are releasably attached to the ribs 118 to facilitate servicing of these components.

With reference to FIG. 3, each intake passage 86 delivers the fuel/air charge to the respective crankcase chamber 64 through a read-type check valve 120 connected to the intake manifold 88. The read-type check valve 120 permits air to flow into the crankcase chamber 64 when the corresponding piston 54 moves toward top dead center (TDC), but precludes reverse flow when the piston 54 moves toward bottom dead center (BDC) to compress the charge delivered to the crankcase chamber 64. The reed-type check valves 120 are mounted to a support plate 122 that lies between the intake manifold 88 and the crankcase member 58.

As best understood from FIG. 5, each intake passage 86 delivers the fuel/air charge either to the upper or lower side of the corresponding crankcase chamber 64 and cylinder 52. For instance, as seen in FIG. 5, the uppermost intake passage 86 delivers the charge to the lower side of the crankcase chamber 64, while the adjacent intake passage 86 delivers the charge to the upper side of the respective crankcase chamber 64. In this manner, the intake passages 86 direct the fuel/air charge into the crankcase chamber 64 to the side of the corresponding connecting rod 56 operating in the chamber 64.

With reference back to FIG. 2, movement of the piston 54 toward bottom dead center (BDC) compresses the fuel/air charge in the respective crankcase chamber 64. The fuel/air charge flows into the combustion chamber through a plurality of scavenge passages 124 as the piston 54 moves toward the bottom of its stroke. The scavenge passages 124 terminate in respective scavenge ports 126 which are formed in the cylinder liner. The fuel/air charge enters the combustion chamber through the scavenge ports 126.

The charge in the combustion chamber is fired by the spark plug 70 when the piston 54 lies at approximately top dead center (TDC). The spent charge is then discharged through an exhaust port 128 and passage 130. The exhaust passage 130 communicates with the cylinder bore 52 through the exhaust port 128 formed in the cylinder liner. The exhaust port 128 desirably lies at a position which is generally diametrically opposite to one of the scavenge ports 126. The configuration of the ports 126, 128 is believed conventional and further description is not believed necessary in order to understand the present fuel injected induction system 12.

The exhaust passages 120 communicate with an exhaust system (not shown) of the outboard drive 10. The exhaust system includes an exhaust pipe (not shown) which depends from the engine into an exhaust expansion chamber (not shown) located in the drive shaft housing 24. The exhaust system of the outboard drive 10 discharges the exhaust gases from the outboard drive 10 in a conventional way, such as, for example, by discharging the exhaust gases through the lower unit 26 and the propeller hub 28.

Figure 6:
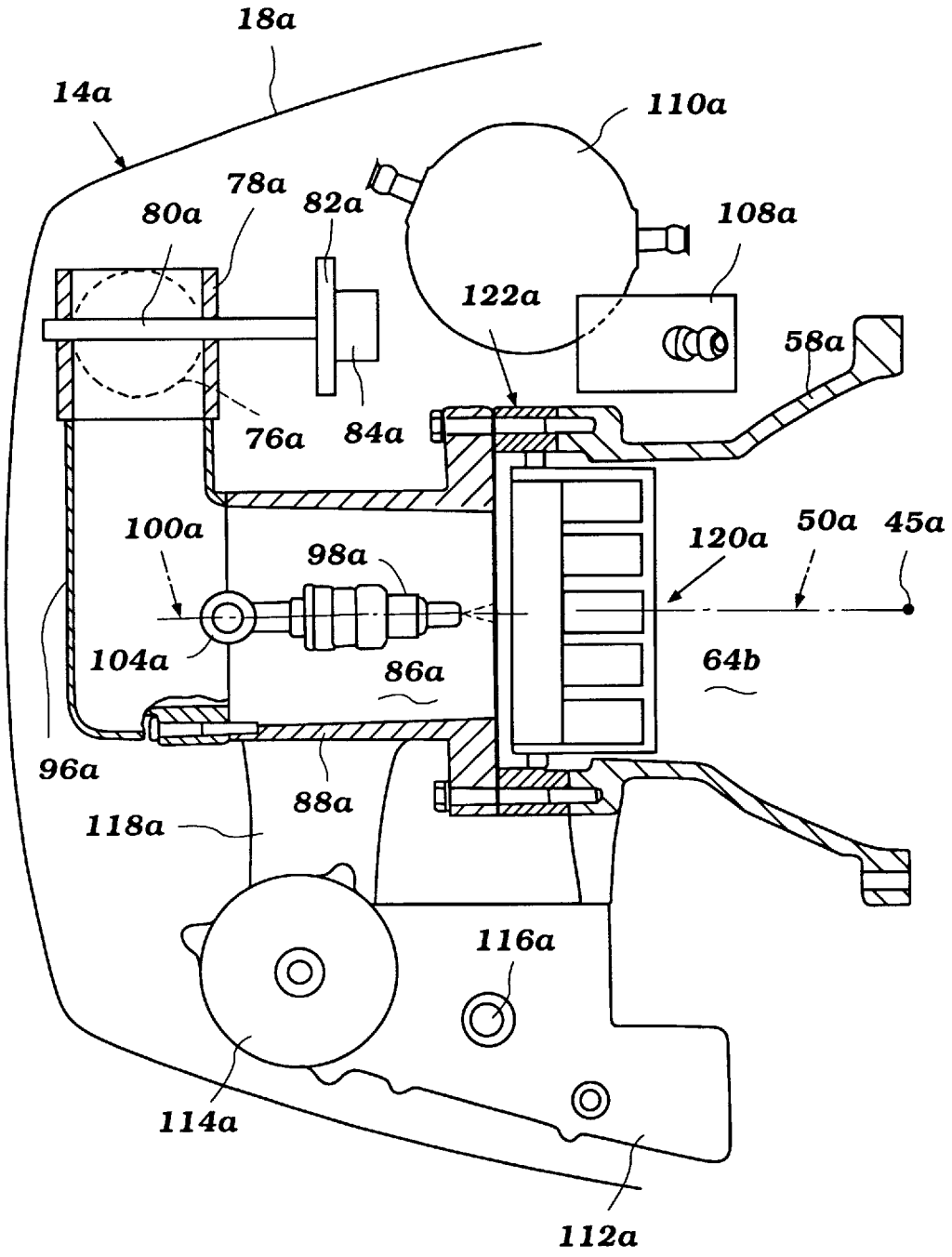
FIG. 6 is an enlarged side cross-sectional view of a fuel injected induction system for a marine engine in accordance with another preferred embodiment of the present invention.

FIG. 6 illustrates an additional embodiment of the present fuel injected induction system with an alter arrangement of the intake manifold, runners, and throttle bodies. Where appropriate, like reference numbers with an "a" suffix have been used to indicate like parts of the two embodiments for ease of understanding.

In the embodiment illustrated in FIG. 6, each throttle body 78*a* is positioned to lie generally normal to the intake manifold 88*a*. That is, the flow axis through the throttle body 78*a* is generally perpendicular to the flow axis through the corresponding intake passage 86*a* of the intake manifold 88*a*. The respective runner 94*a*, therefore, generally has an "L" shape to direct the intake air flow through about a 90° directional turn from the throttle body 78*a* into the intake manifold 88*a*. As seen in FIG. 6, the flow axis through the intake manifold 88*a* and the spray axis 100*a* of the corresponding fuel injector 98*a* lie within the central plane 50*a* of the engine 16*a*.

Figure 7:
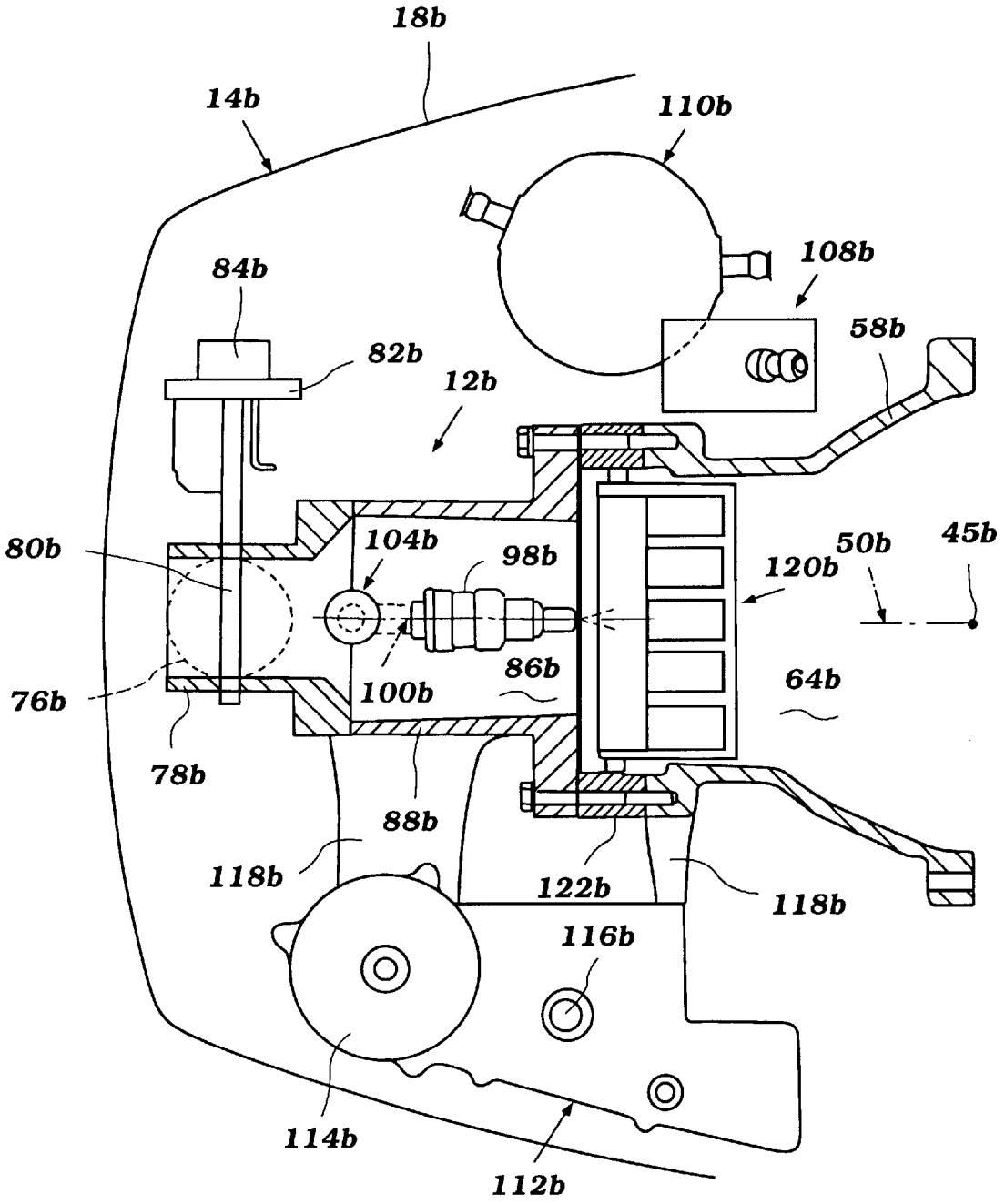
FIG. 7 is an enlarged side cross-sectional view of a fuel injected induction system for a marine engine in accordance with an additional preferred embodiment of the present invention.

FIG. 7 illustrates another embodiment of the present fuel injected induction system with an alter arrangement of the intake manifold and throttle bodies. Where appropriate, like reference numbers with a "b" suffix have been used to indicate like parts of the embodiments of FIGS. 3 and 7 for ease of understanding.

In the embodiment illustrated in FIG. 7, each throttle body 78*b* is aligned with the flow axis (i.e., center line) of the corresponding intake passage 86*b*. The throttle bodies 78*b* are directly connected to the manifold 88*b* on the opposite side of the intake manifold 88*b* from the crankcase member 58*b*. So positioned, the flow axis through the intake manifold 88*b* and the spray axis 100*b* of the corresponding fuel injector 98*b* aline with the central plane 50 of the engine 16*b*.

Figure 8:
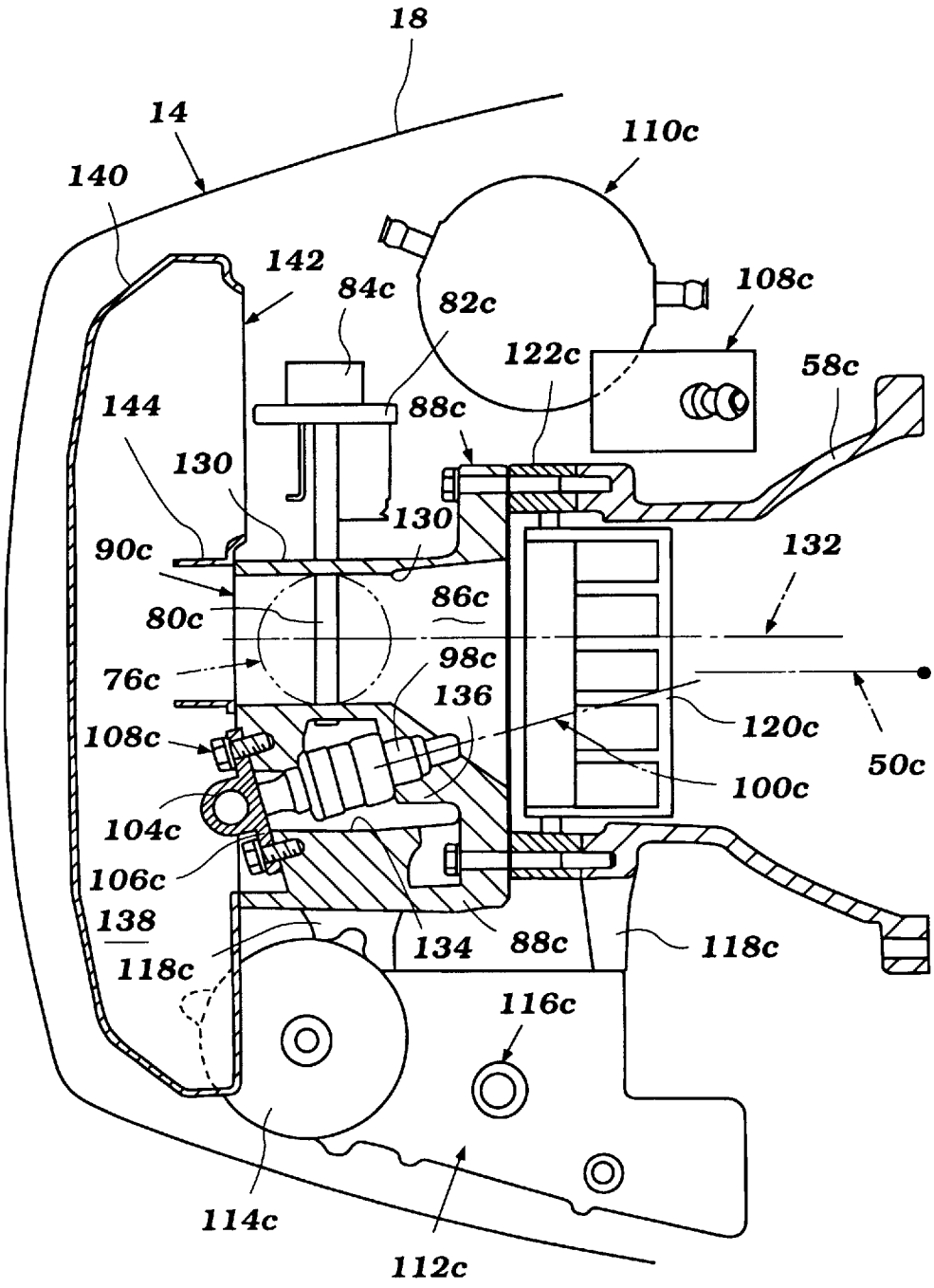
FIG. 8 is an enlarged side cross-sectional view of a fuel injected induction system for a marine engine in accordance with another preferred embodiment of the present invention.

FIG. 8 illustrates an additional embodiment of the present fuel injected induction system. Where appropriate, like reference numbers with a "c" suffix have been used to indicate like parts of the embodiments of FIGS. 3 and 8 for ease of understanding.

As seen in FIG. 8, each throttle valve 76*c* lies within a throat 130 of the respective intake passage 86*c* of the intake manifold 88*c*. In this embodiment, the flow axis 132 through the intake passage 86*c* lies to the side of the engine center line 50*c*.

The intake manifold 88*c*. includes a channel 134 which extends substantially along the length of the intake manifold 88*c* at a position adjacent to the throttle valves 76*c*. A plurality of bosses 136 lie within the channel 134. Each boss 136 is positioned to the side of a respective intake passage 86*c*. The boss 136 receives a fuel injector 98*c* which is disposed so that its spray axis 100*c* injects toward the center plane 50*c* of the engine 16*c* and into the air flow stream through the intake passage 86*c* at a point downstream from the throttle valve 76*c*. The body of each fuel injector 98*c* lies within the channel 134.

A fuel rod 104*c* supplies fuel to each of the fuel injectors 98*c*. The fuel rod 104*c* extends along the upper end of the channel 134 on the inlet side of the intake manifold 88*c*. Bolts 108*c* secure the flanges 106*c* on the fuel rod 104*c* to the end surface 90*c* of the intake manifold 88*c*. In this position, the fuel rod 104*c* covers only a portion of the channel 134 to allow air circulation within the channel 134. A portion of the fuel rod 104*c* also projects beyond the end surface 90*c* of the intake manifold 88*c* into a chamber 138 defined within an intake silencer 140.

The intake silencer 140 is attached to the opposite side of the intake manifold 88*c* from the crankcase member 58*c*. The silencer 140 includes an inlet 142 positioned to the side of the intake manifold 88*c* so as to draw air into the induction system 12*c* from the interior of the cowling 18*c*. The inlet 142 opens into the chamber 138 which has a volume substantially larger than the volume of one of the intake passages 86*c*. In the illustrated embodiment, the silencer 140 has a width substantially larger than the width of the intake manifold 88*c*, and is equal to about the width of the cowling 18*c* at its aft end.

As seen in FIG. 8, the silencer 140 includes an annular flange 144 with circumscribes the mouth of the intake passage 86*c*. The flange 144 separates the silencer inlet 142 from the mouth of the intake passage 86*c* to produce an air flow within the silencer chamber 138.

Air flows into the silencer chamber 138 from a point on the peripheral side of the cowling 18*c* through the silencer inlet 142. When the throttle valve 76*c* is opened, air flows through the intake passage 86. Air also circulates within the chamber 138 and the channel 134 over the fuel rod 104*c*. The respective injector 98*c* injects fuel into the air stream which flows into the crankcase chamber 64*c* through the reed-type valves 120*c*. The air/fuel charge is then delivered to the combustion chamber, fired therein and exhausted through the exhaust system in the manner described above.

As common to all of the embodiments described above, the induction system includes a dedicated throttle device, intake pathway and fuel injector for each crankcase chamber. This arrangement improves the consistence of the fuel/air charge between the chambers and enhances the control over the air/fuel ratio in the charge supplied to each chamber.

In each of the embodiments, the fuel rod also lies within the air flow path of the induction system. In some embodiments, the fuel rod lies within the air flow stream through the intake passages. In another embodiment, the fuel rod lies in the air flow path within the manifold plenum. The intake air cools the fuel within the fuel rod as it flows over fuel rod. Consequently, the fuel is maintained at a lower temperature as it enters the fuel injectors.

The releasable attachment of the manifold cover or intake silencer also allows easy access to the fuel injection system. The simple mounting arrangement of the fuel rod and injectors permits these components to be easily removed for servicing or repair. In addition, the simple construction of the induction system reduces assembly time and decreases labor costs.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. An induction system for a two-cycle, crankcase compression, internal combustion engine having multiple cylinders, the engine comprising a plurality of crankcase chambers each communicating with a respective cylinder of the engine, said induction system being attachable to a crankcase member of the engine on a side opposite of the cylinders and comprising an intake manifold defining a plurality of intake passages, all of the intake passages being arranged in a row with corresponding flow axes through the intake passages lying generally within a common plane, each intake passage communicating with a respective one of said crankcase chambers, and a plurality of throttle devices, each throttle device communicating with a respective one of the intake passages, and all of the throttle devices being arranged in a row generally parallel to the row of intake passages.

2. An induction system as in claim 1 additionally comprising a plurality of fuel injectors, at least one fuel injector positioned to inject fuel into each of said intake passages.

3. An induction system as in claim 2, wherein said injector is disposed within said intake passage.

4. An induction system as in claim 3 additionally comprising a fuel rod extending transversely through said intake passages and being coupled to each of said fuel injectors.

5. An induction system as in claim 4, wherein said fuel rod is removably attached to an end of intake manifold opposite of the crankcase chambers.

6. An induction system as in claim 5 additionally comprising a cover removably attached to said intake manifold and to throttle bodies in which throttle valves of said throttle device are supported.

7. An induction system as in claim 6, wherein said cover defines a plurality of runners, each runner extending between one of said throttle bodies and a respective one of said intake passages in said intake manifold.

8. An induction system as in claim 2, wherein said row of intake passages is generally upstanding with the intake passages generally arranged above one another, and each intake passage delivers a fuel/air charge to the respective crankcase chamber on an upper or lower side of the corresponding cylinder.

9. An induction system as in claim 2, wherein said fuel injectors are positioned to align the spray axes of the injectors with a central plane bifurcating the engine.

10. A fuel injected induction system for a two-cycle, crankcase compression, internal combustion engine having multiple cylinders, the engine including a plurality of crankcase chambers each communicating with a respective cylinder of the engine, said fuel injected induction system being attached to the engine on the opposite side of the crankcase chambers from the cylinders and comprising a plurality of intake passages formed in an intake manifold, each intake passage communicating with one of the crankcase chambers, and a fuel rod at least partially lying within each of said intake passages and supplying fuel to a plurality of fuel injectors, one of said fuel injectors being disposed within each of said intake passages.

11. A fuel injected induction system as in claim 10, wherein said fuel rod lies generally parallel to an axis of a crankshaft of the engine.

12. A fuel injected induction system as in claim 10, wherein said fuel rod is removably attached to an end of intake manifold opposite of the crankcase chambers.

13. A fuel injected induction system as in claim 10 additionally comprising a plurality of throttle devices corresponding in number to the number of intake passages.

14. A fuel injected induction system as in claim 13, wherein each throttle device communicates with a respective one of said intake passages.

15. A fuel injected induction system as in claim 14 additionally comprising a cover removably attached to said intake manifold and to throttle bodies in which said throttle valves of the throttle device are supported, said cover defining a plurality of runners with each runner extending between one of said throttle bodies and a respective one of said intake passages in said intake manifold.

16. An induction system as in claim 10, wherein said fuel rod is arranged generally upright and each intake passage delivers a fuel/air charge to the respective crankcase chamber on an upper or lower side of the corresponding cylinder.

17. An induction system as in claim 10, wherein said fuel injectors are positioned to align the spray axes of the injectors with a central plane bifurcating the engine.

18. A fuel injected induction system for a two-cycle, crankcase compression, V-type internal combustion engine having multiple cylinders, the engine including a plurality of crankcase chambers, each of which communicating with a cylinder of the engine, said fuel injected induction system being attached to the engine on the opposite side of the crankcase chambers from the cylinders and comprising at least one air flow passage communicating with a plurality of intake passages, each intake passage communicating with one of the crankcase chambers through an opening disposed between the corresponding intake passage and crankcase chamber, and a fuel rod supplying fuel to a plurality of fuel injectors, one of said fuel injectors being disposed within each of said intake passages and positioned to align a spray axis of said injector with a central plane of the V-type engine and with a center of the respective opening between the corresponding intake passage and crankcase chamber, said fuel rod being mounted within said air flow passage.

19. A fuel injected induction system as in claim 18, wherein said air flow passages is divided to form a plurality of induction conduits, each induction conduit communicating with one of said intake passages.

20. A fuel injected induction system as in claim 18, wherein said fuel injectors and said fuel rod are mounted to an intake manifold which defines said intake passages, said fuel rod being located upstream of the injectors in the air flow stream through the intake manifold.

21. A fuel injected induction system for a two-cycle, crankcase compression, internal combustion engine having multiple cylinders, the engine comprising a plurality of crankcase chambers each communicating with a cylinder of the engine, said fuel injected induction system comprising plurality of intake passages, each of said intake passages communicating with a respective one of said crankcase chambers, a plurality of fuel injectors positioned such that one of said fuel injectors injects into each intake passage, a fuel rod coupled to each fuel injector, a plurality of throttle devices corresponding in number to the number of intake passages and attached such that one of said throttle devices communicates with a respective one of said intake passages, and a throttle linkage coupled to said throttle devices on a side of the throttle devices which is diametrically opposite of the side on which said fuel rod lies.

22. A fuel injected induction system as in claim 21, wherein said plurality of intake passages lie in a first row and said plurality of throttle devices lie in a second row, said first and second rows being substantially parallel to each other.

23. A fuel injected induction system as in claim 21, wherein said fuel rod is removably attached to an end of intake manifold opposite of the crankcase chambers.

24. A fuel injected induction system as in claim 23 additionally comprising a cover removably attached to said intake manifold and to throttle bodies in which said throttle valves of said throttle devices are supported.

25. A fuel injected induction system as in claim 24, wherein said cover defines a plurality of runners, each runner extending between one of said throttle bodies and a respective one of said intake passages in said intake manifold.

26. A fuel injected induction system as in claim 24, wherein said intake manifold and said throttle bodies are integrally formed together.

27. A fuel injected induction system as in claim 21, wherein each intake passage delivers a fuel/air charge to the respective crankcase chamber on an upper or lower side of the corresponding cylinder.

28. A fuel injected induction system as in claim 21, wherein said fuel injectors are positioned to align the spray axes of the injectors with a central plane bifurcating the engine.

29. A fuel injected induction system as in claim 21 additionally comprising a fuel vapor separator communicating with said fuel rod, said fuel-vapor separator being removably attached to said intake manifold on an opposite side of the intake manifold from said throttle devices.

* * * * *

UNITED STATES PATENT AND TRADEMARK OFFICE

CERTIFICATE OF CORRECTION

PATENT NO. : 5,803,050

DATED : September 8, 1998

INVENTOR(S) : Takayuki Osakabe, et. al.

It is certified that error appears in the above-identified patent and that said Letters Patent is hereby corrected as shown below:

Claim 21, Column 12, line 10, "and attached" should be --and arranged--.

Claim 29, Column 12, line 45, "fuel-vapor" should be --fuel vapor--.

Signed and Sealed this

Sixth Day of April, 1999

*Attest:*

*Attesting Officer*

Q. TODD DICKINSON

*Acting Commissioner of Patents and Trademarks*